United States Patent [19]

Vermillion

[11] 4,370,838

[45] Feb. 1, 1983

[54] CURTAIN WALL

[75] Inventor: Eugene F. Vermillion, Columbus, Ohio

[73] Assignee: The Columbus Show Case Company, Columbus, Ohio

[21] Appl. No.: 178,148

[22] Filed: Aug. 14, 1980

[51] Int. Cl.[3] ..... E04H 1/00

[52] U.S. Cl. ..... 52/36; 52/241; 52/127.9

[58] Field of Search ..... 52/36, 127, 238–241

[56] References Cited

U.S. PATENT DOCUMENTS

| | | | |
|---|---|---|---|
| 1,329,427 | 2/1920 | Otto | 52/127 |
| 1,462,208 | 7/1923 | Mayo | 52/211 |
| 2,275,109 | 3/1942 | McGee | 52/241 |
| 3,017,672 | 1/1962 | Vaughan | 52/241 |
| 3,101,817 | 8/1963 | Radek | 52/241 |
| 3,300,926 | 1/1967 | Heirich | 52/300 |
| 3,492,766 | 2/1970 | Andrews | 52/36 |
| 3,828,495 | 8/1974 | Law | 52/36 |
| 3,958,372 | 5/1976 | Bonhow | 52/36 |

FOREIGN PATENT DOCUMENTS

| | | | |
|---|---|---|---|
| 2039207 | 1/1971 | France | 52/36 |

*Primary Examiner*—Henry E. Raduazo
*Assistant Examiner*—Rice C. Faw, Jr.
*Attorney, Agent, or Firm*—William Rambo

[57] ABSTRACT

A curtain wall or paneling system for concealing and beautifying an existing structural wall features a pair of elongated, upper cap and lower sill-forming channel members which are attached in predetermined, vertically spaced relation on the existing wall and which support and hold a plurality of transversely spaced apart, vertically elongated metallic studs or pilasters and decorative wall panels. The length of the studs and wall panels are correlated to the spacing between and depth of the upper cap and lower sill channel members, so that they may be easily lifted into and out of engagement with the cap and sill channel members.

7 Claims, 10 Drawing Figures

FIG. 3
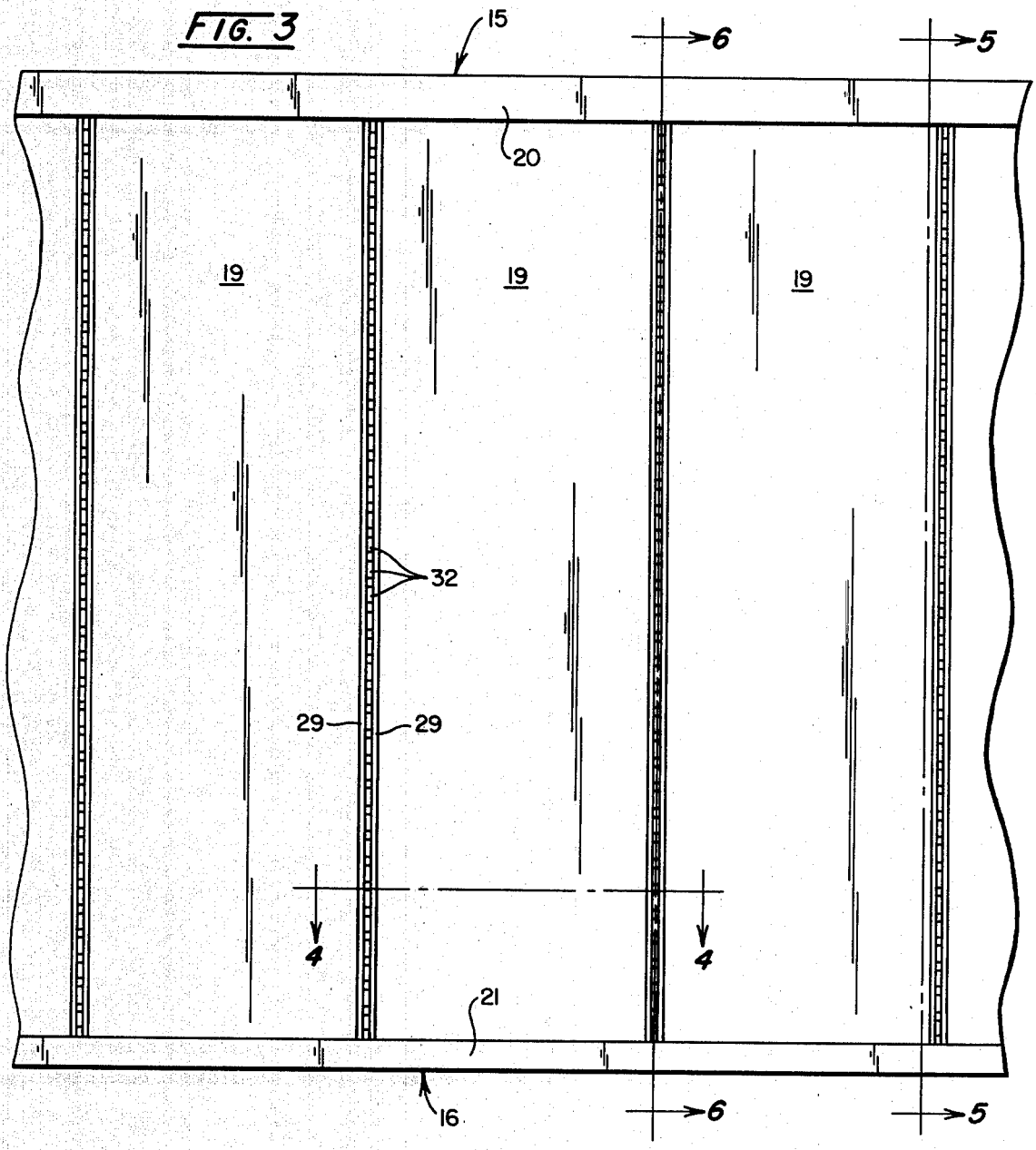
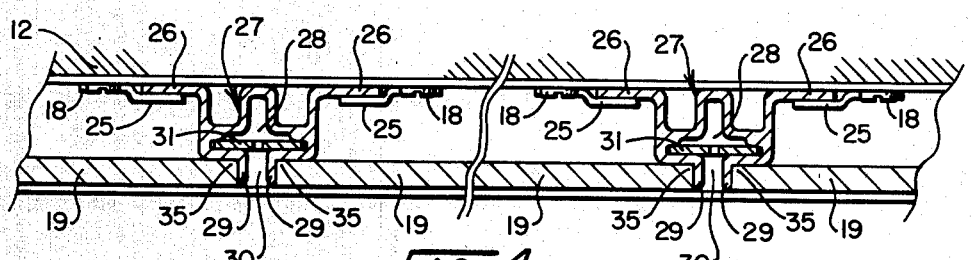
FIG. 4

CURTAIN WALL

BACKGROUND OF THE INVENTION

This invention relates generally to non-load-bearing curtain walls or wall-paneling systems, and more particularly to an improved wall-paneling or skin system for easy application to an exposed face of an existing wall structure, The application of decorative panels, skins and coverings to improve or modernize the aesthetics of an old or beat-up wall is well and familiarly known in the art. Wall-paneling systems and/or partition walls which employ upper caps and lower sills of channel-form to support a number of wall panels in side-by-side relation are also well known in the art. U.S. Pat. Nos. 1,462,208 issued July 17, 1923 to Mayo; 3,017,672 issued Jan. 23, 1962 to Vaughan and 3,300,926 issued Jan. 31, 1967 to Heirich disclose wall constructions and wall-paneling systems which are typical of the prior art, and these patents represent the most pertinent art known to the applicant.

The primary difficulties and expenses encountered in applying decorative and/or functional paneling to an old existing wall stem from dimensional variations in the old wall, out of plumb, unlevel and non-parallel floors and ceilings, etc. Such dimensional variations in the old wall and adjacent floors and ceilings often make it necessary to apply furring strips or planks to the old wall surface and/or leveling shims or strips to the adjacent floor and ceiling surfaces prior to applying wall panels or other decorative skin materials to the old wall. All of this requires considerable labor and greatly increases the expense of paneling and redcorating an old wall.

While channel-form cap and sill members have heretofore been used to contain and hold the upper and lower edge portions of vertical wall boards and panels, such cap and sill members or channels have usually been attached to the ceiling and floor adjacent the wall to be covered, rather than to the wall itself. As will be readily understood, the floors and ceilings of older buildings are seldom level or truly parallel to one another. Thus, when channel-form cap and sill strips are attached to the ceiling and floor of a room, it is usually necessary to either cut the panels or wall boards to different lengths, or install leveling blocks or shims between the strips and the adjoining ceiling or floor to insure that the ceiling-attached cap strip is parallel to and uniformly spaced above the associated floor-attached, sill strip. Also, the use of floor and ceiling-attached channel strips to frame the upper and lower edges of wall paneling makes it necessary to either preassemble the wall paneling within the cap and sill frame channels prior to securing the frame channels to the ceiling and floor, or attach removable side plates or strips to the cap or sill frame member to retain the panels therein. All of this greatly increases the labor and expense attendant to the erection or installation of a neat and attractive curtain or panel wall.

SUMMARY AND OBJECTS OF THE INVENTION

The present invention provides an improved curtain or panel wall designed for easy and expeditious application to either an old, or a newly constructed wall and which utilizes a pair of upper and lower channel-form frame members or strips which are nailed, screwed, or otherwise rigidly secured, in vertically spaced apart, parallel and coplanar relation, to the existing wall, and which are arranged to detachably receive and support therebetween a plurality of preformed metallic studs and decorative, rectangular panels. The lengths of the metallic studs and decorative panels is correlated to the vertical spacing between the upper and lower channel-form frame members so that the studs and panels may be readily installed within the frame members simply by tilting the studs and panels slightly and inserting their upper ends into the upper channel-form frame member and then lifting the lower ends of the studs and panels over the outer lip of the lower channel-form frame member and dropping them into the channel of the lower frame member. The preformed metallic studs are formed or otherwise provided with longitudinally coextensive, outwardly projecting separator ribs which function to support and slightly separate the adjacent longitudinal side edges of a pair of rectangular panel members. The preformed metallic studs are also provided with internal, perforated bracket attachment strips or bars which are accessible by way of an outwardly opening channel or slot formed between the panel separator ribs of the stud, and which are adapted to receive and support the hooked base end portion of one or more shelf brackets, or cantilever-type support arms disposed in outwardly projecting relation to the studs and wall panels.

Optionally, the preformed metallic studs may also include a substantially concealed, manually operable panel-locking or latching device which is selectively engageable with a catch on an adjacent panel to firmly lock an intermediate portion of the panel to the stud to thereby prevent outward bowing or flexing of the panel.

The primary object of the invention is to provide a curtain wall or wall-paneling system which may be installed in covering relation to either a new or old structural wall with a minimum of labor and erection expense.

Another object is to provide a wall-paneling system whose supporting frame is composed of vertically spaced apart, horizontally extending upper and lower channel members nailed or otherwise fastened to an existing wall to define upper and lower coplanar channels into which a system of preformed metallic studs and decorative rectangular panels may be readily inserted to cover and decorate the existing wall.

Additional objects and advantages of the present invention will become more readily apparent from the following description and the accompanying drawings.

BRIEF DESCRIPTION OF THE DRAWINGS

FIG. 3 is a segmental front elevational view of a wall according to this invention;

FIG. 4 is an enlarged, fragmentary horizontal sectional view taken approximately along the section line 4—4 of FIG. 3;

DESCRIPTION OF THE PREFERRED EMBODIMENT

Figure 1:
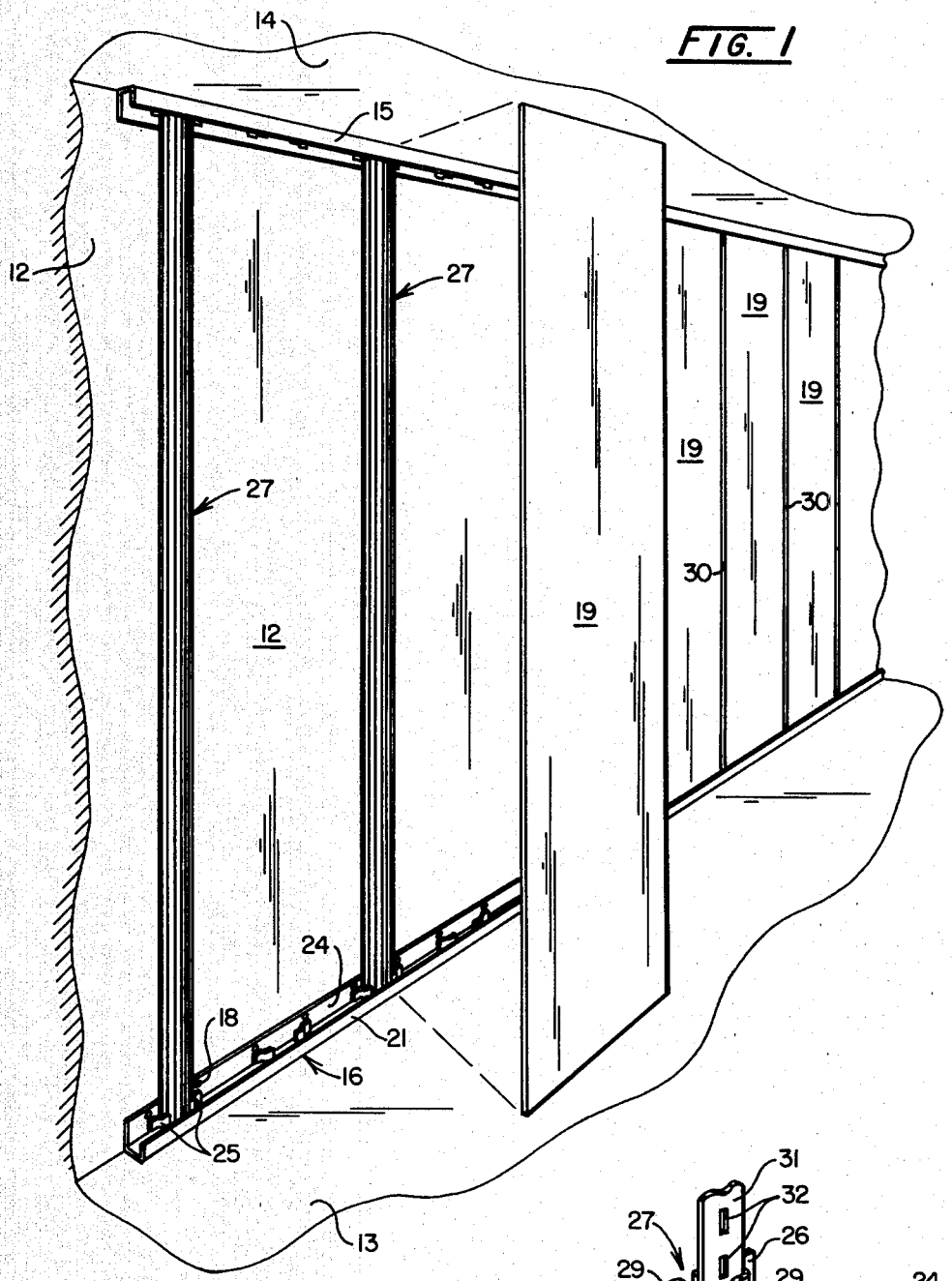
FIG. 1 is a perspective view showing a wall according to this invention being applied to an adjacent, existing wall of a building.

With reference to the drawings, it will be seen that the present invention provides a curtain wall, or wall-paneling system for covering and decorating an existing wall 12 within a building or room which also includes a floor surface 13 and a ceiling 14. Advantageously, the present wall-paneling system may be employed to remodel and redecorate the interior vertical walls of a retail sales room or other merchandise display room, although it may be used with equal facility to decorate a newly constructed wall.

Toward this end, the present wall-paneling system comprises a pair of upper and lower channel-form frame members 15 and 16, respectively, which are rigidly secured to the wall 12 in horizontally extending order and in relatively vertically spaced apart, coplanar, parallel relationship. Each of the frame members 15 and 16 are formed at longitudinally spaced intervals with fastener-receiving openings 17 through which nails, bolts, rivets and/or screws 18 may be driven to secure the frame members to the adjacent wall surface. In rooms and/or buildings where the floor surface 13 is substantially level and horizontal, the lower channel-form frame member 16 may be positioned in direct abutment with the floor surface 13 adjacent the wall 12. However, when an uneven floor surface 13 is encountered, the lower frame member 16 is leveled independently of the floor surface. Likewise, the upper frame member 15 is installed in exacting horizontal disposition parallel to the lower frame member 16. The vertical spacing between the frame members 15 and 16 is predetermined by the height or length of the panels 19 used to form the curtain wall or paneling.

It will be understood that in redecorating certain relatively older rooms or buildings having unusually high ceilings, it may be desirable to limit the height of the present curtain wall, so that its upper edge terminates a distance below the actual ceiling of the room in which it is positioned, and a valance board or cornice, not shown, may be used in combination with the curtain wall to cover or hide the area of the wall 12 above the curtain wall.

Figure 2:
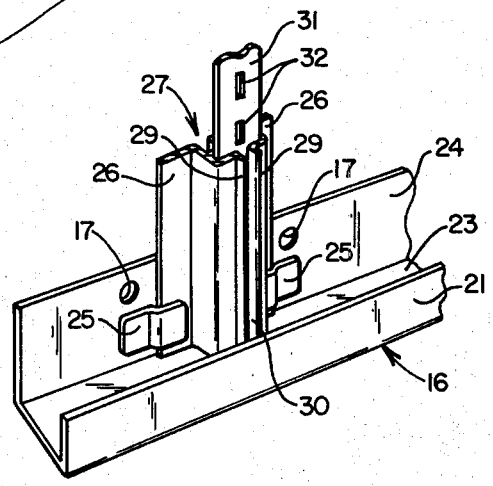
FIG. 2 is an enlarged, fragmentary perspective view of a portion of the lower channel frame member and an adjoining stud member of the present wall.
Figure 5:
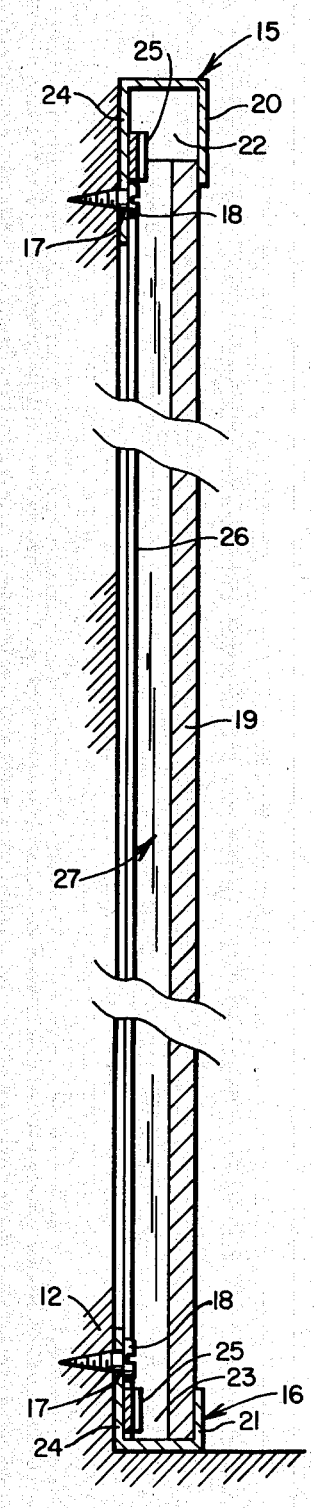
FIG. 5 is an enlarged vertical sectional view taken approximately along the line 5—5 of FIG. 3.
Figure 6:
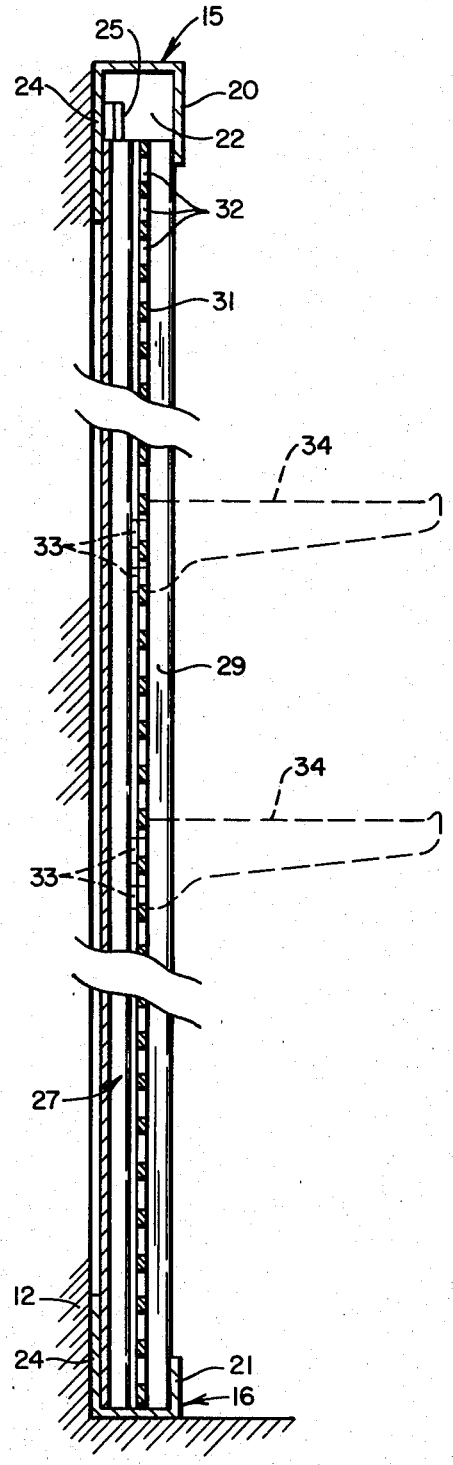
FIG. 6 is a similar view taken through one of the studs along the line 6—6 of FIG. 3.
Figure 9:
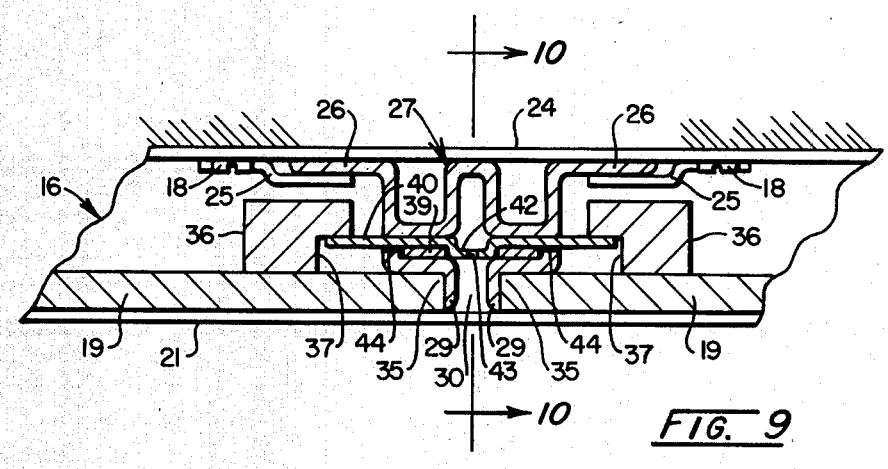
FIG. 9 is a detailed, horizontal sectional view taken through the panel lock and a pair of adjacent panel members.

As best seen in FIGS. 2, 5 and 6, each of the upper and lower frame members 15 and 16 possesses a generally J-shaped cross section and is arranged to define a pair of longitudinally extending, opposed channels opening toward one another. The outer, downturned web or lip 20 of the upper frame member 15 is substantially wider (deeper) than the corresponding outer, upturned web or lip 21 of the lower frame member 16, whereby to define a deeper channel 22 in the upper frame member 15 and a relatively shallower channel 23 within the lower frame member 16. The inner flanges or webs 24 of the upper and lower frame members are of substantially the same width, and are formed at longitudinally spaced intervals therealong with the fastener-receiving openings 17. The fastener-receiving openings 17 are preferably located at a level below the outer flange 20 of the upper frame member 15 and above the outer flange 21 of the lower frame member 16 to provide ample access and clearance to drive the fasteners 18 without interference from the outer channel forming lips 20 and 21.

Each of the upper and lower frame members 15 and 16 are provided at longitudinally spaced intervals therealong with sets of horizontally spaced, stud-locating fingers or clips 25 which may be either welded to, or lanced integrally from the inner flanges 24 of the frame members. The relatively opposing end portions of the stud-locating fingers or clips 25 are spaced slightly outwardly from the rear or inner flanges 24 of the frame members 15 and 16 to provide vertically opening sockets to receive and hold the laterally outwardly projecting base flanges 26 of a preformed, metallic pilaster or stud 27.

Each of the studs 27 possesses the cross sectional configuration shown particularly in FIG. 4 and comprises a generally hollow-form, vertically elongated body of extruded metal formed with a relatively wide, T-shaped internal chamber 28 which extends the full length of the stud. Each of the studs 27 is also formed with a pair of longitudinally coextensive, horizontally spaced apart, and outwardly projecting ribs 29 which define a relatively narrow, outwardly opening continuous channel or slot 30 communicating with the internal chamber 28 of the stud.

Removably positioned in the internal chamber 28 of each of the studs 27 is an elongated, substantially flat, bracket attachment strip or bar 31. As shown particularly in FIG. 2, the bracket attachment bar or strip 31 carried in each stud 27 is formed with a multiplicity of vertically spaced, elongated slots or perforations 32 which are sized and shaped to receive the base hooks or lugs 33 formed on shelf brackets or other outwardly projecting article-supporting arms, as indicated by broken lines at 34 in FIG. 6.

As illustrated more particularly in FIGS. 5 and 6 of the drawings, the height or length dimensions of the preformed studs 27 is slightly less than the spacing between the top and bottom walls of the upper and lower frame members 15 and 16. The depth of the upper channel 22 is such that the upper end of the studs 27 may be raised (lifted) within the upper channel 22 a distance sufficient to permit the lower ends of the studs 27 to be lifted over the lip 21 and the stud-locating clips 25 of the lower frame member 16. In this elevated position, the lower ends of the studs 27 may be lifted into and out of the channel 23 of the lower frame member 16. When it is desired to introduce a stud member 27 into the channel-form frame members, the upper end portion of the stud member 27 is angled into the channel 22 of the upper frame member 15 to engage its base flanges 26 with the stud-locating clips 25 of the upper frame member, and then the stud member is lifted so that its lower end clears the lip 21 and clips 25 of the lower frame member 16. The vertically positioned stud member 27 is then lowered to engage the side flanges 26 with the stud-locating clips or fingers 25 of the lower frame member. FIGS. 5 and 6 illustrate the stud members 27 in their lowermost, fixed positions within the upper and lower frame members 15 and 16, but it will be seen that the depth of the upper channel 22 is such as to permit the lower end of the stud member 27 to be lifted vertically to a position at which its lower end will clear the lower stud-locating clips 25 and the upper edge of the lip 21, in which position the lower end of the stud may be swung outwardly to disengage the stud entirely from the frame members 15 and 16.

As indicated particularly in FIG. 4, the outwardly projecting, longitudinally coextensive ribs 29 define on each of the studs 27 a pair of longitudinally coextensive, right-angular, entrant corner seats 35 to receive the longitudinal side edges of the adjacent wall panels 19. The thickness of each of the panels 19, at least along its opposite side edges, is approximately equal to the depth of the entrant corner seats 35, so that the outer surfaces of the panels 19 are disposed in substantially flush, coplanar relation to the outer edges of the ribs 29 of the studs 27. Thus, the relatively spaced apart ribs 29 of the studs function to separate the longitudinal side edges of a pair of adjacent panels 19, thereby providing easy access to the bracket attachment strip 31 by way of the outwardly opening channel 30 formed between each pair of ribs 29.

As previously indicated, the length of the wall panels 19 corresponds to the length of the studs 27, so that the wall panels 19 may be inserted into the upper and lower channels 22 and 23 of the frame members 15 and 16 in substantially the same manner as the studs 27, that is, by first inserting the upper edges of the panels within the upper channel 22 and then elevating the panel 19 to a position at which its lower edge clears the lip 21 of the lower frame member 16, and then lowering the lower end of the panel 19 into the lower channel 23.

The horizontal spacing between the sets of stud-locating clips 25 on each frame member 15 and 16 is preferably predetermined, so that the studs 27 may be arranged to receive panels 19 of different widths. For example, if the clips 25 are spaced on 12 inch centers, the studs may be positioned to receive and support panels varying in width from approximately 12–60 inches. Regardless of the particular preselected spacing between the sets of clips 25, the studs 27 may be located to receive and support a group of panels 19 of either uniform or varying widths.

It will also be understood that the wall panels 19 may vary widely not only in width, but in their appearance and composition. For example, the panels 19 may be formed from colored or mirrored glass, perforated peg boards, plain or slat surface plywood, sheet metal laminates, plaster board, or combinations of such materials. Further, the decoration and composition of alternating or adjacent panels 19 may be varied to provide alternating colors and surface finishes according to the choice and taste of the interior designer.

Figure 8:
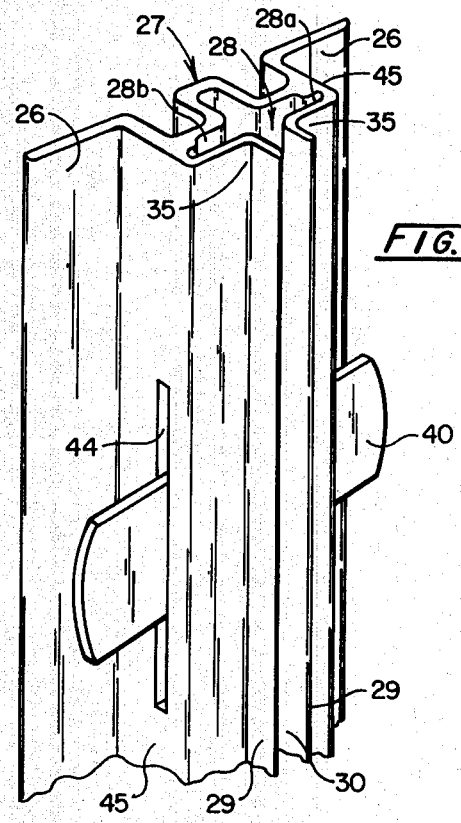
FIG. 8 is an enlarged, fragmentary perspective view of a portion of a stud showing the panel lock or latch in extended position.

As will be noted particularly in FIGS. 4 and 8, the transverse or cross portion of the internal chamber 28 of the stud includes two relatively adjoining passages or slots **28*a* and 28*b* of different widths to accomodate two different sizes of bracket attachment strips or bars 31. Thus, when the thickness or rigidity of the relatively thin and wide strip 31 is insufficient to support a given heavy load or bending moment, a relatively thicker, but narrower attachment strip (not shown) may be substituted for the strip 31. The relatively thicker substitute strip will have a width substantially equal to that of the narrower slot 28*b* of the channel 28 and its thickness may be substantially equal to the combined depths of the slots 28*a* and 28*b***.

In some instances, the length and thickness dimensions, as well as the composition, of the panels 19 may be such that the panels will tend to bow outwardly from the studs 27 in their unsupported intermediate regions. In such instance, the panels 19 may be provided along their back sides, and a distance inwardly from their outer side edges with one or more longitudinally extending catch strips 36 which are formed with grooves or recesses 37 opening toward an adjacent metallic stud 27. The studs 27, in turn, may be provided with a manually-operated latch or lock mechanism, such as illustrated in FIGS. 7–10 inclusive, to engage with the catch strips 36 and hold the intermediate regions of the panels 19 in tight fitting engagement with the entrant corner seats 35 of the stud. The lock or latch, generally indicated at 38, is composed of a pair of superposed, substantially flat, but relatively rotatable rectangular plates 39 and 40. The width of the plates 39 and 40 correspond to the widths of the slots **28*a* and 28*b*, respectively, formed in the studs 27. The foremost or stationary plate 39 is formed with a central circular opening 41 which rotatably receives an outwardly pressed, circular, disk-like boss 42 formed in the central portion of the movable latch plate 40. The central disk-like boss 42 of the movable latch plate 40 is formed with a rectangular opening or slot 43 into which the tip of a screwdriver or similar flat headed tool may be inserted and twisted to rotate the latch plate 40 relative to the plate 39**.

Figure 7:
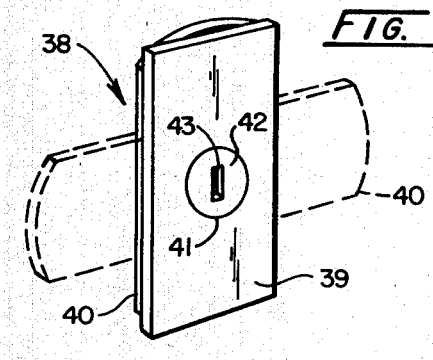
FIG. 7 is an enlarged detail perspective view of a lock or latch element removed from an associated stud.
Figure 10:
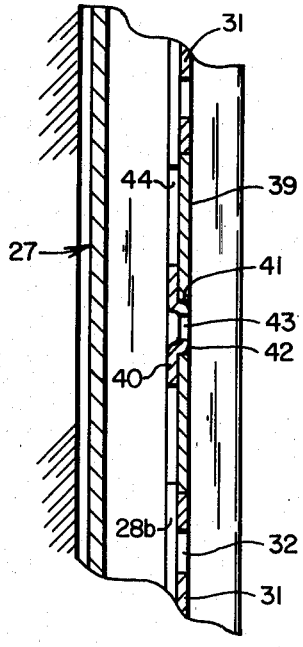
FIG. 10 is a fragmentary vertical sectional view taken along the line 10—10 of FIG. 9.

The lock or latch assembly 38 is sized to be slidably received within the slots **28*a* and 28*b* of the stud 27 when the front and rear plates 39 and 40 occupy their superposed but parallel positions as indicated by full lines in FIG. 7. The lock assembly 38 is supported within the stud 27 in registry with a pair of laterally opening slots 44 formed in the side walls 45 of the central portion of the stud. As indicated in FIG. 10, the relatively stationary, forward plate 39 of the latch assembly 38 is held in position with respect to the side slots 44 of the stud 27 by being sandwiched between two segments of the perforated bracket attachment strip or bar 31. In other words, in its unlocked condition with the forward and rear plates 39 and 40 disposed in superposed parallel relation, the latch assembly 38 may be slidably received in the internal chamber or channel 28 of the stud and stacked between two segments of the bracket attachment bar 31 in registry with the laterally opening slots 44 of the stud 27. In operation, the movable latch plate 40 of the lock assembly 38 may be rotated or pivoted to extend its ends through the slots 44 and into locking engagement with the catch strips 36 of the panels simply by introducing the blade portion of a screwdriver through the access slot or channel 30 of the stud and into the rectangular slot 43 of the latch plate 40, and rotating the blade of the screwdriver 90°. Conversely, the latch plate 40 of the lock assembly 38 may be moved to its unlocked position in parallelism with the stationary face plate 39, so as to disengage the latch plate 40 from the catch strips 36 of the panels 19**.

In view of the foregoing, it will be seen that the present invention provides a versatile, easily installed curtain wall or wall-paneling system which features readily insertable and removable panel sections and vertical studs.

While presently preferred embodiments of the invention have been illustrated and described in detail, it will be understood that various modifications in details of construction and design may be resorted to without departing from the spirit of the invention or the scope of the following claims.

I claim:

1. A wall comprising:

(a) a pair of opposed, elongated channel-form frame members disposed in vertically spaced apart, generally coplanar relation and defining, respectively, upper and lower channels opening toward one another, said lower channel being shallower than said upper channel;

(b) a plurality of vertically arranged, horizontally spaced apart, hollow-form, studs of integral, one-piece construction having upper and lower end portions extending, respectively, into said upper and lower channels, each of said studs including longitudinally coextensive, outward projecting, panel-separating means;

(c) a rectangular wall panel extending between said channel-form frame members and spanning the space between a pair of said studs and having opposite side edges disposed in substantial abutment with the panel-separating means of each of said pair of studs, and having catch means disposed adjacent a side edge thereof, said panel and studs having length dimensions permitting their ready removal from said channel-form frame members simply by lifting their lower ends above and moving them outwardly from said lower channel; and (d) a manually operable latch carried by at least one of said studs and accessible through a slot formed in the panel-separating means of the stud, said latch being selectively movable to engage the catch means of said panel and thereby lock said panel to the stud.

2. A wall according to claim 1, wherein each of said channel-form frame members is provided at longitudinally spaced intervals therealong with stud-locating fingers, and said studs have their upper and lower end portions detachably engaged with the stud-locating fingers of said frame members.

3. A wall according to claim 1, wherein each of said studs contains a longitudinally extending, perforated, bracket-anchoring strip, and said panel-separating means defines a longitudinally extensive, outwardly opening access channel to said strip.

4. A wall according to claim 1, wherein the panel-separating means of each of said studs consists of a pair of integral, transversely spaced apart ribs extending longitudinally of said stud and projecting outwardly therefrom, each of said ribs forming on said stud a longitudinally coextensive, right angular, entrant corner seat for a side edge of an adjacent wall panel.

5. A wall according to claim 1, wherein each of said studs is hollow and includes an internal, longitudinally coextensive chamber containing a perforated, bracket-anchoring strip.

6. A wall according to claim 1, wherein each of said channel-form frame members is formed at longitudinally spaced intervals with openings through which a fastener may be passed to secure said frame member to an adjacent supporting wall.

7. In a wall paneling system; a panel-positioning stud comprising an elongated, hollow column of integral, one-piece construction formed with a longitudinally coextensive internal chamber of generally rectangular cross-section and a pair of relatively spaced apart, longitudinally coextensive, outwardly projecting ribs, said ribs defining on an outer face of said column a pair of transversely spaced apart, longitudinally coextensive, entrant corner, panel-receiving seats separated by a longitudinally coextensive, outwardly opening channel communicating with and disposed in generally perpendicularly intersecting relation to the internal chamber of said column; a perforated, bracket-anchoring strip of rectangular cross-section carried in the internal chamber of said column and accessible through the channel defined by said ribs; and a manually-operable, laterally extensible latch carried in the internal chamber of said column and accessible through said channel, said latch being selectively movable between a position of confinement within the chamber of said column and a laterally extended position adjacent the panel-receiving seats of said column.

* * * * *